US006378995B1

(12) United States Patent
Yun et al.

(10) Patent No.: US 6,378,995 B1
(45) Date of Patent: Apr. 30, 2002

(54) MANUFACTURING METHOD OF NOZZLE PLATE USING SILICON PROCESS AND INK JET PRINTER HEAD APPLYING THE NOZZLE PLATE

(75) Inventors: Sang Kyeong Yun; Sung June Park, both of Suwon-Shi (KR)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 09/444,119

(22) Filed: Nov. 19, 1999

(30) Foreign Application Priority Data

Jul. 7, 1999 (KR) ..... 99-27325

(51) Int. Cl.[7] ..... B41J 2/045
(52) U.S. Cl. ..... 347/70
(58) Field of Search ..... 347/71, 70, 54, 347/68, 47; 216/27

(56) References Cited

U.S. PATENT DOCUMENTS 5,831,651 A * 11/1998 Usui et al. ..... 347/70
5,852,456 A * 12/1998 Okada et al. ..... 347/71

FOREIGN PATENT DOCUMENTS

JP 2001-030500 A * 2/2001 ..... B41J/2/135

OTHER PUBLICATIONS

Bassous, Fabrication of Novel Three–Dimensional Microstructures by the Anisotropic Etching of (100) and (110) Silicon, IEEE Transactions on Electron Devices, vol. ED–25, No. 10, Oct. 1978, pp. 1178–1185.*

* cited by examiner

*Primary Examiner*—John Barlow
*Assistant Examiner*—Ly T Tran
(74) *Attorney, Agent, or Firm*—Darby & Darby

(57) ABSTRACT

The present invention relates to methods of manufacturing a nozzle plate using a silicon process comprising the steps of providing a silicon substrate; forming a silicon oxide film on one side of the silicon substrate; patterning the silicon oxide film; performing an anisotropic wet etching on the silicon substrate after shielding the surface of the silicon substrate where silicon oxide film has not been formed; forming a boron layer on surface where silicon oxide film has been formed in the silicon substrate; etching the silicon substrate where the boron layer has been formed; and removing the silicon oxide film and the boron layer formed on the silicon oxide film by etching the silicon oxide film, or comprising the steps of: providing a silicon substrate; forming a boron layer on one surface of the silicon substrate; masking another surface of the silicon substrate where boron layer is not formed, into a desired pattern; performing an anisotropic wet etching of the patterned silicon substrate; masking the boron layer into a desired pattern; and forming a straight part at the boron layer by way of dry etching of the masked boron layer, nozzle plates manufactured by the methods, and ink jet printer heads applying the nozzle plates.

30 Claims, 5 Drawing Sheets

MANUFACTURING METHOD OF NOZZLE PLATE USING SILICON PROCESS AND INK JET PRINTER HEAD APPLYING THE NOZZLE PLATE

BACKGROUND OF THE INVENTION

1. Field of the Invention

The present invention relates a manufacturing method of a nozzle plate and an ink jet printer head applying the nozzle plate. In particular, the invention relates a manufacturing method of a nozzle plate for an ink jet printer head by etching a silicon substrate and an ink jet printer head manufactured by applying the nozzle plate manufactured by the method.

2. Description of the Prior Art

An ink jet printer head is generally formed by sequential accumulation of a nozzle plate 222 where a nozzle 223 has been formed, a reservoir plate 221 where a reservoir 220 is formed, a channel plate 219 where a flow channel 218 is formed, a restrictor plate 217 where a restrictor 216 is formed, a chamber plate 215 forming a chamber 214, and an actuator composed of three parts of an upper electrode 210, a piezoelectric substance 211 and a lower electrode 212 which is formed on a substrate 213 as in FIG. 1.

By the construction, ink travel paths such as nozzle 223, reservoir 220, flow channel 218, restrictor 216, chamber 214 of mutually different sizes and shapes are formed in the ink jet printer head.

Ink supplied from an ink canister not shown in figure is reserved in the reservoir 220 after which it flows into the chamber 214 through the flow channel 218 whence the reservoir 220 formed between the flow channel 218 and the chamber 214 maintains the ink flow speed into the chamber 214 to a constant state.

The piezoelectric substance 211 is actuated if voltage is applied at the upper electrode 210 and the lower electrode 212 of the actuator formed on the chamber 214; by the actuation of the piezoelectric substance 211, the volume of the chamber 214 momentarily decreases while the ink in chamber 214 is ejected through the nozzle 223 formed in the nozzle plate 222 onto a material on which to be recorded. Printing is carried out by the ejection of ink.

A meniscus, which is exposed to atmosphere at an outlet part of the nozzle plate because of inertial flow of ink for sake of refilling the ejected amount of ink after ink is ejected, takes vibration, and the vibration of the meniscus might be inferred by resonance equation of fluid system.

Because ink cannot be ejected while the meniscus vibrates, it is important to attenuate and stabilize the vibration of the meniscus in a short time in order to decrease the interval until the next ink ejection. The ejection frequency of a printer head can be increased if the vibration of the meniscus can be attenuated in shorter time.

As for a method for attenuating rapidly the vibration of the meniscus, there is generally used method to strengthen the attenuating function by increasing the viscosity of ink or by decreasing the diameter of outlet part of the nozzle plate.

So the outlet part of the nozzle plate is a important factor in an ink jet printer head, affecting the ejecting ability of the ink drop and the stability after ink is ejected.

So far the cross section shape of the outlet part of the nozzle plate was made to have a suitable length of straight part in order to diminish the diameter of the outlet part of the nozzle plate.

The nozzle plate having a suitable length of straight part at the outlet part can rapidly attenuate the vibration of the meniscus because the diameter of the part becomes less than that of other part.

Because the nozzle plate having a suitable length of straight part at the outlet part is to construct a printer head by assembling flow channel, chamber, actuator etc. over itself and the ink flowing through nozzle is made to form laminar flow at straight part when ink is ejected, thus the straight mobility of ink is improved. Therefore dispersion or precision of position, at which point the ink drop lands on material on which to be recorded, is improved so that printed state is improved.

Metal has generally been used as material for nozzle plate wherefore so far method to form the nozzle plate by electroforming and method to form it by micro punching and polishing process have been used in order to manufacture it using a metal.

Photoresist is thinly coated on a substrate and then patterned in electroforming method. If the patterned substrate is immersed in electrolytic solution and is electrified, plating material grows on the substrate; and the plating is stopped if plating material has grown to a nozzle size to use. Whence the plating has been completed, then nozzle plate where nozzle has been formed is completed by removing the substrate and the photoresist that has been formed on the substrate.

A metal sheet for use as a nozzle plate is drawn by micro punching pin to form a nozzle cross section through depth beyond opposite side of the metal sheet, in a method to form the nozzle plate by micro punching and polishing process. Protruded part of the metal sheet after drawing is removed by polishing process; and burr on the metal sheet occurred by polishing process is removed by electrolytic polishing or chemical polishing.

There are cases where a nozzle plate is formed using a single crystal silicon instead of metal in case of continuous type ink jet head or an ink jet head applying thermal expansion of film or bubble jet.

A method for anisotropic etching of silicon in bulk micro machining technique is used in a case of forming the nozzle plate using single crystal silicon as raw material.

As for etching liquid to form a nozzle in silicon substrate by anisotropic etching, anisotropic etching liquid such as potassium hydroxide (KOH) and trimethylamine hydroxide{TMAH} are used by which nozzle is made by forming pyramidal hole in square or circle pattern by anisotropic etching of silicon substrate of (100) crystal direction.

Whence etching can be inhibited for parts other than part to be etched as a nozzle, by way of masking the parts using a silicon oxide film or a silicon nitride film as the shield film.

For this, after masking the parts other than part to be etched, by way of masking the parts using a silicon oxide film or a silicon nitride film, nozzle is made by forming pyramidal hole in silicon substrate of (100) crystal direction using an anisotropic etching liquid.

Whence the shape of nozzle end and the cavity of nozzle are controlled by etching liquid, etching time duration and etching rate of silicon.

Also straight part may be formed by forming a square nozzle on the opposite side using an isotropic etching liquid after anisotropic etching.

But there are problems that the straight forwardness becomes low when ink is ejected in case that a nozzle is formed by being etched only using an anisotropic etching, and that the nozzle formed is not uniform because the degree of etching of each part becomes different as etching is repeated in case that the nozzle plate is formed isotropic etching after anisotropic etching.

Therefore an ink jet printer head applying the nozzle plate has the same problem.

SUMMARY OF THE INVENTION

The present invention to solve the above problem aims to provide a method of manufacturing a precise and uniform nozzle plate by anisotropic wet etching applying a high concentration boron layer as the etching interruption layer in forming the nozzle plate by etching the silicon substrate and to provide an ink jet printer head applying the manufactured nozzle plate.

The present invention to achieve the purpose features a method of manufacturing a nozzle plate using a silicon process comprising the steps of: providing a silicon substrate; forming a silicon oxide film on one side of the silicon substrate; patterning the silicon oxide film; performing an anisotropic wet etching on the silicon substrate after shielding the surface of the silicon substrate where silicon oxide film has not been formed; forming a boron layer on surface where silicon oxide film has been formed in the silicon substrate; etching the silicon substrate where the boron layer has been formed; and removing the silicon oxide film and the boron layer formed on the silicon oxide film by etching the silicon oxide film.

Also the present invention features a method of manufacturing a nozzle plate using a silicon process comprising the steps of: providing a silicon substrate; forming a boron layer on one surface of the silicon substrate; masking another surface of the silicon substrate where boron layer is not formed, into a desired pattern; performing an anisotropic wet etching of the patterned silicon substrate; masking the boron layer into a desired pattern; and forming a straight part at the boron layer by way of dry etching of the masked boron layer.

Also the present invention features an ink jet printer head comprising: a substrate; a chamber which is formed under the substrate and which is open only in bottom part; a nozzle plate formed under the substrate and the chamber; a nozzle to record by ejecting ink, formed in the nozzle plate; a boron layer which is formed on the slope of the nozzle and whose end is projected to media side; a lower electrode formed on the substrate; a piezoelectric substance which is formed on the lower electrode and which actuates when voltage is applied; and an upper electrode formed on the piezoelectric substance.

Also the present invention features an ink jet printer head comprising: a substrate; a chamber which is formed under the substrate and which is open only in bottom part; a nozzle plate formed under the substrate and the chamber; a nozzle to record by ejecting ink, formed in the nozzle plate; a boron layer which is formed under the nozzle plate and which forms a straight part at the outlet part of the nozzle; a lower electrode formed on the substrate; a piezoelectric substance which is formed on the lower electrode and which actuates when voltage is applied; and an upper electrode formed on the piezoelectric substance.

Also the present invention features an ink jet printer head comprising: a substrate; a chamber plate formed under the substrate; a chamber formed in the chamber plate; a restrictor plate formed under the chamber and the chamber plate; a restrictor which is formed in the restrictor plate and which makes to maintain the speed of ink flowing into chamber at a constant value; a channel plate formed under the restrictor plate; a flow channel which is formed in the channel plate and which is a travel path of ink; a reservoir plate formed under the channel plate; a reservoir to reserve the ink, formed by the reservoir plate; a nozzle plate formed under the reservoir plate; a nozzle to record by ejecting ink, formed in the nozzle plate; a boron layer which is formed on the slope of the nozzle and whose end is projected to media side; a lower electrode formed on the substrate; a piezoelectric substance which is formed on the lower electrode and which actuates when voltage is applied; and an upper electrode formed on the piezoelectric substance.

Also the present invention features an ink jet printer head comprising: a substrate; a chamber plate formed under the substrate; a chamber formed in the chamber plate; a restrictor plate formed under the chamber plate; a restrictor which is formed in the restrictor plate and which makes to maintain the speed of ink flowing into chamber at a constant value; a channel plate formed under the restrictor plate; a flow channel which is formed in the channel plate and which is a ink travel path; a reservoir plate formed under the channel plate; a reservoir to reserve the ink, formed by the reservoir plate; a nozzle plate formed under the reservoir plate; a nozzle to record by ejecting ink, formed in the nozzle plate; a boron layer which is formed under the nozzle plate and which forms a straight part at the outlet part of the nozzle; a lower electrode formed on the substrate; a piezoelectric substance which is formed on the lower electrode and which actuates when voltage is applied; and an upper electrode formed on the piezoelectric substance.

DETAILED DESCRIPTION

The present invention is explained in detail referring to appended drawings.

A silicon substrate is used as nozzle plate material. Silicon has merit that there does not arise the deterioration of an ink jet printer head by reaction between ink and nozzle plate for long time use because silicon is low in reactivity with ink.

Figure 1:
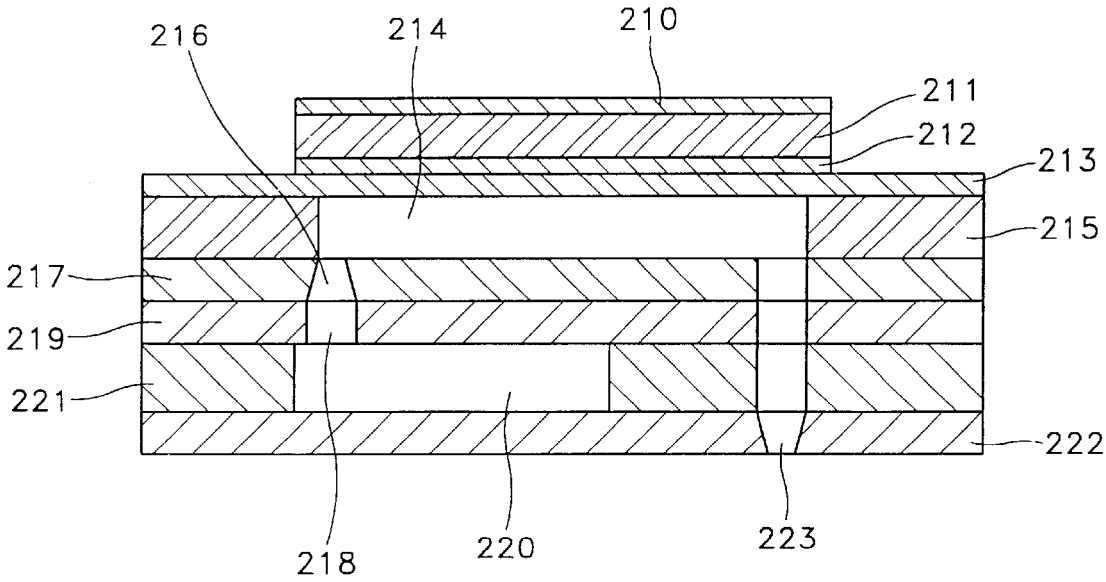
FIG. 1 is a cross section view showing an example of a general ink jet printer head.
Figure 2:
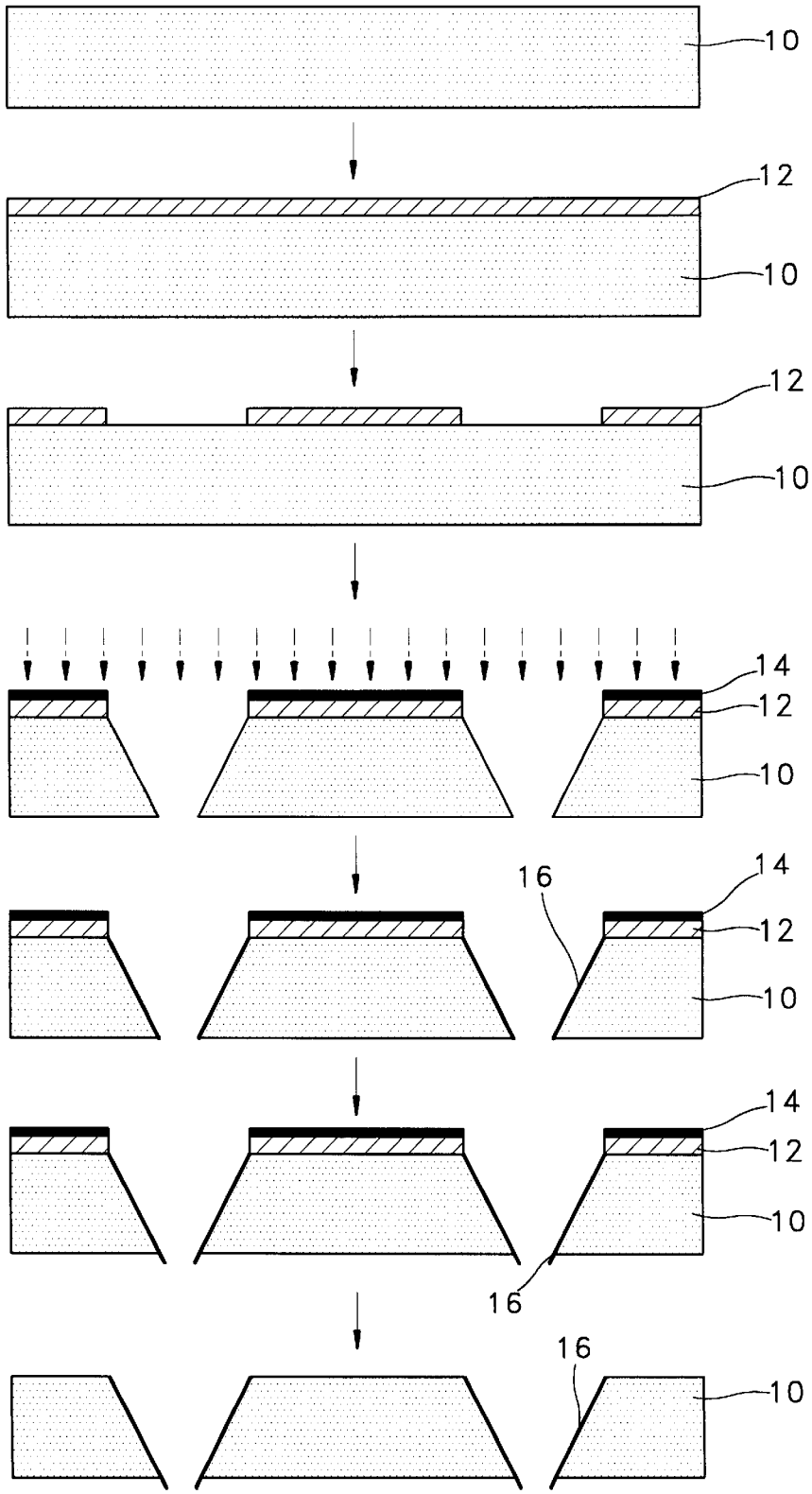
FIG. 2 is a process diagram showing an example of manufacturing method of a nozzle plate using a silicon process of the present invention.

FIG. 2 shows an example of manufacturing method of nozzle plate using a silicon process of the present invention.

Silicon oxide film 12 is formed on one side of a silicon substrate 10. The silicon oxide film 12 is formed either by thermal oxidation of silicon substrate or by thermal oxidation after molding a silicon oxide film by atmosphere pressure chemical vapor deposition {APCVD}, plasma enhanced chemical vapor deposition {PECVD} or sputtering.

Whence it is preferable to form the silicon oxide film 12 having a thickness of 0.5–3 μm.

The silicon substrate 10 is etched using an anisotropic etching liquid, after patterning the silicon oxide film 12 formed on silicon substrate 10, into desired pattern to form a nozzle plate.

Whence only the part of the silicon substrate where the silicon oxide film 12 has been removed is etched because the surface where silicon oxide film 12 has been formed acts as a masking layer where silicon oxide film 12 inhibits etching, with other surface where the silicon oxide film 12 has not been formed, of course, being masked by other masking contrivances so that the other surface shall not be etched.

Whence for anisotropic etching liquid, materials such as mixed solution of potassium hydroxide and amine, base of amines, and potassium hydroxide are generally used. And a pyramidal nozzle plate is formed on the silicon substrate 10 as anisotropic etching liquid is used.

A boron layer 14, 16 is formed by injection of high concentration boron on the silicon substrate 10 where silicon oxide film 12 has been formed after etching was finished.

It is preferable to inject boron in high concentration about $7\times10_{19}$ atoms/cm$^3$ when forming the boron layer 14, 16 whereby this layer 14, 16 injected of high concentration acts as an etching interruption layer which would not be etched.

Whence it is preferable to form the boron layer 14 having a thickness below 5 μm and particularly 1–2 μm.

After the boron layer 14, 16 formation, the silicon substrate 10 is etched again to remove tens μm of the silicon substrate on opposite side. Whence the surface where the boron layer 14, 16 has been formed is not etched but the opposite surface where the boron layer 14, 16 has not been formed is etched. Whence the formed nozzle plate is uniform because the boron layer 14, 16 of high concentration acts as an etching stop layer.

The nozzle plate is completed by removing with selective etching of the silicon oxide film 12 if the silicon substrate 10 has been etched to a desired thickness. The boron layer 14 formed on the silicon oxide film 12 is also removed if the silicon oxide film 12 is etched.

The nozzle plate manufactured by the method is excellent in the straightness characteristics of ink ejection because the end of the nozzle plate is protruded about tens μm to media side.

Hydrophilic treatment may also be performed, forming a silicon oxide film on the surface of the nozzle plate manufactured by the method which interfaces with a flow channel.

The silicon oxide film is formed by the method described above. It is preferable to form the silicon oxide film having a thickness of 0.5–3 μm and particularly 1 μm.

The nozzle plate manufactured by the method is excellent in the straightness characteristics of ink ejection because the end of the nozzle plate is projected about tens μm to media side.

Figure 3:
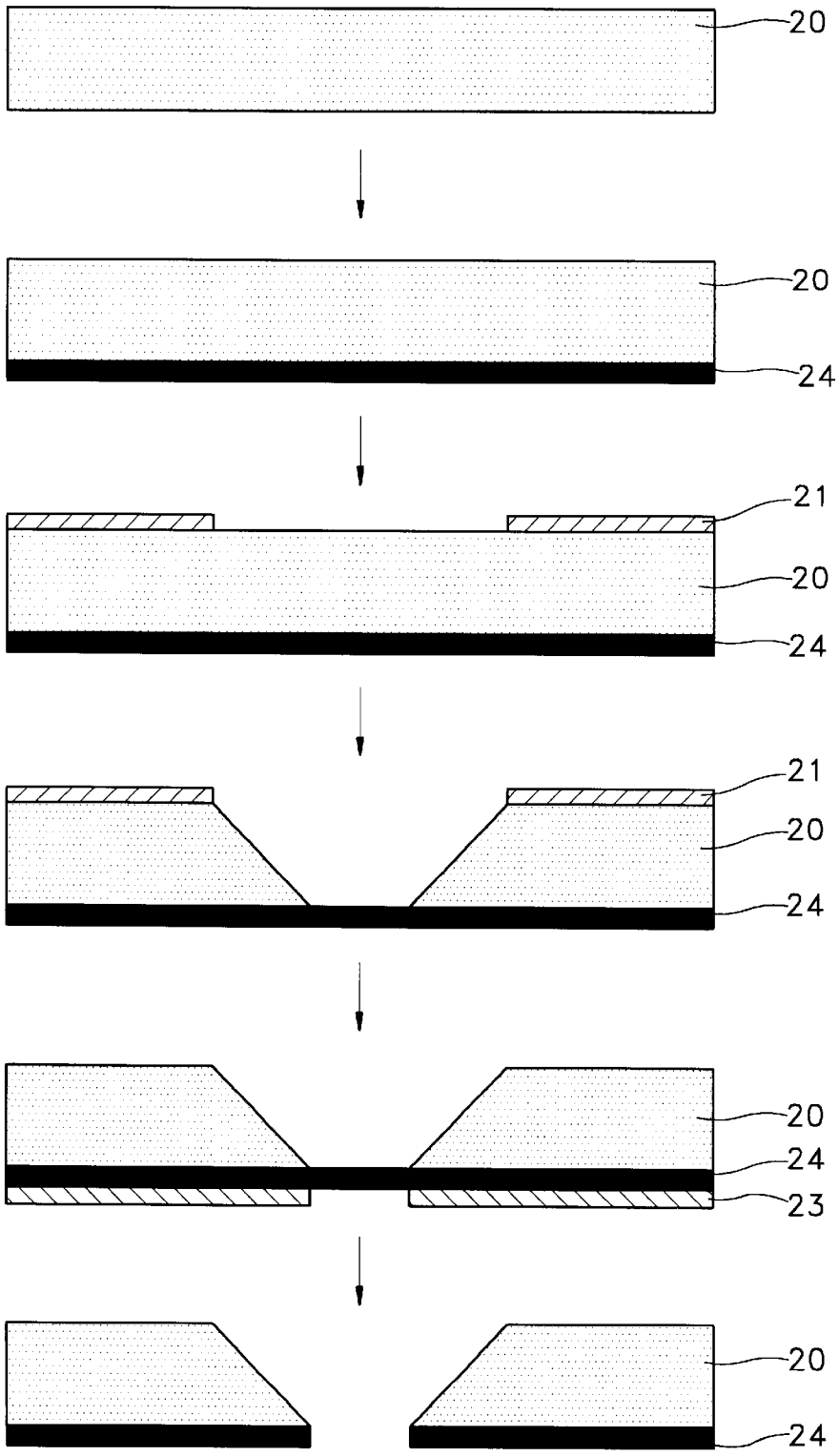
FIG. 3 is a process diagram showing an example of another manufacturing method of a nozzle plate using a silicon process of the present invention.

FIG. 3 shows an example of other manufacturing method of nozzle plate using a silicon process of the present invention.

At first, a boron layer 24 is formed by boron injection on one side of surface of a silicon substrate 20.

It is preferable to inject boron in high concentration about 7□0$^{19}$atoms/cm$^3$ when forming the boron layer 24 whereby the boron layer injected of high concentration of boron acts as an etching stop layer which inhibits etching.

Whence it is preferable to form the boron layer 24 having a thickness of below 15 μm and particularly below 5 μm.

Wet etching is performed using anisotropic etching liquid after patterning to a desired pattern by masking using such as photoresist or shadow mask 21 on the part of the surface where boron layer has not been formed in the silicon substrate 20 where the boron layer 24 has been formed.

Whence only surface where the boron layer has not been formed is etched in pyramid type while the surface where the boron layer has been formed is not etched because the boron layer 24 acts as an etching stop layer.

Photoresist or shadow mask 21 used in patterning is removed after etching is completed.

Then straight part at the outlet part of the nozzle plate is formed by dry etching after the boron layer 24 is patterned by masking the boron layer 24 using such as photoresist or shadow mask 23. Whence it is preferable to use a plasma etching for the dry etching method.

After etching is completed, the nozzle plate is completed by removing photoresist or shadow mask 23 used in patterning.

Hydrophilic treatment may also be performed, forming a silicon oxide film on the surface of the nozzle plate manufactured by the method which interfaces with a flow channel.

Whence also the silicon oxide film is formed by the method described above. It is preferable to form the silicon oxide film having a thickness of 0.5–3 μm and particularly 1 μm.

The nozzle plate manufactured by the method is excellent in straightness characteristics of ink ejection because straight part is formed at the outlet part of nozzle plate.

The nozzle plate manufactured by the present invention method has clean cross section because high concentration boron layer acts as an etching stop layer and are uniform in diameter. And the deterioration of an ink jet printer head is prevented because silicon which the reactivity between the nozzle plate and ink is low is used as nozzle plate material.

And straightness characteristics of ink ejection is improved because the end of nozzle plate is protruded about tens μm to media side or a straight part is formed at the outlet part of the nozzle plate.

And a variety of methods can be used when the nozzle plate bonds with an ink jet printer head body; and the bonding is easy with all materials of silicon, metal, polymer, ceramic etc. In particular, if the material of an ink jet printer head body is silicon, because ink jet printer head can be produced by directly bonding the manufactured nozzle plate and silicon, process becomes simple and production cost is lowered.

And bubble generated inside ink by contact with the nozzle plate can be suppressed by hydrophilic treatment on the surface of the nozzle plate facing with a flow channel side.

Now is explained an ink jet printer head applying the nozzle plate manufactured by the method.

The nozzle plate manufactured by the method can be applied to all general ink jet printer heads.

An ink jet printer head applying the nozzle plate of the present invention comprises a substrate; a chamber which is formed under the substrate and which is open only in bottom part; a nozzle plate formed under the substrate and the chamber; a nozzle to record by ejecting ink, formed in the nozzle plate; a boron layer which is formed on the slope of the nozzle and whose end is projected to media side; a lower electrode formed on the substrate; a piezoelectric substance which is formed on the lower electrode and which actuates when voltage is applied; and an upper electrode formed on the piezoelectric substance.

Also an ink jet printer head applying the nozzle plate of the present invention comprises a substrate; a chamber which is formed under the substrate and which is open only in bottom part; a nozzle plate formed under the substrate and the chamber; a nozzle to record by ejecting ink, formed in the nozzle plate; a boron layer which is formed under the nozzle plate and which forms a straight part at the outlet part of the nozzle; a lower electrode formed on the substrate; a piezoelectric substance which is formed on the lower electrode and which actuates when voltage is applied; and an upper electrode formed on the piezoelectric substance.

Ink is stored in the chamber in the ink jet printer head constituted as above. If actuator actuates by application of voltage at micro actuator formed on the substrate, the volume of the chamber momentarily decreases while ink in the chamber is ejected through the nozzle. Then ink is supplied again in the chamber after the ink is ejected so that the process recycles.

And the ink jet printer head may further comprises a restrictor plate where a restrictor is formed, between the substrate and the nozzle plate, a channel plate where a flow channel is formed, and a reservoir plate where a reservoir is formed.

An ink jet printer head so further comprising the above elements comprises a substrate; a chamber plate formed under the substrate; a chamber formed in the chamber plate; a restrictor plate formed under the chamber and the chamber plate; a restrictor which is formed in the restrictor plate and which makes to maintain the speed of ink flowing into chamber at a constant value; a channel plate formed under the restrictor plate; a flow channel which is formed in the channel plate and which is a travel path of ink; a reservoir plate formed under the channel plate; a reservoir to reserve the ink, formed by the reservoir plate; a nozzle plate formed under the reservoir plate; a nozzle to record by ejecting ink, formed in the nozzle plate; a boron layer which is formed on the slope of the nozzle and whose end is projected to media side; a lower electrode formed on the substrate; a piezoelectric substance which is formed on the lower electrode and which actuates when voltage is applied; and an upper electrode formed on the piezoelectric substance.

An ink jet printer head so further comprising the above elements comprises a substrate; a chamber plate formed under the substrate; a chamber formed in the chamber plate; a restrictor plate formed under the chamber plate; a restrictor which is formed in the restrictor plate and which makes to maintain the speed of ink flowing into chamber at a constant value; a channel plate formed under the restrictor plate; a flow channel which is formed in the channel plate and which is a ink travel path; a reservoir plate formed under the channel plate; a reservoir to reserve the ink, formed by the reservoir plate; a nozzle plate formed under the reservoir plate; a nozzle to record by ejecting ink, formed in the nozzle plate; a boron layer which is formed under the nozzle plate and which forms a straight part at the outlet part of the nozzle; a lower electrode formed on the substrate; a piezoelectric substance which is formed on the lower electrode and which actuates when voltage is applied; and an upper electrode formed on the piezoelectric substance.

By the above construction, ink travel paths such as reservoir, flow channel and restrictor having mutually different size and shape are additionally formed.

In the ink jet printer head having the above constitution, ink supplied from a ink canister is reserved in the reservoir after which it flows into the chamber through the flow channel whence the reservoir formed between the flow channel and the chamber maintains the flow speed of ink into the chamber to a constant state.

The actuator actuates if voltage is applied to the actuator formed on the chamber. By the actuation, the volume of the chamber momentarily decreases while ink in the chamber is ejected through the nozzle. Then ink is supplied again in the chamber after ink is ejected.

Also ink jet printer head can have effect as explained above for the nozzle plate, by applying in ink jet printer head the nozzle plate manufactured by the method.

Examples of an ink jet printer head of the present invention are now explained referring to appended drawings. But the following examples are only illustrations of the invention and do not confine the extent of the invention.

Figure 4:
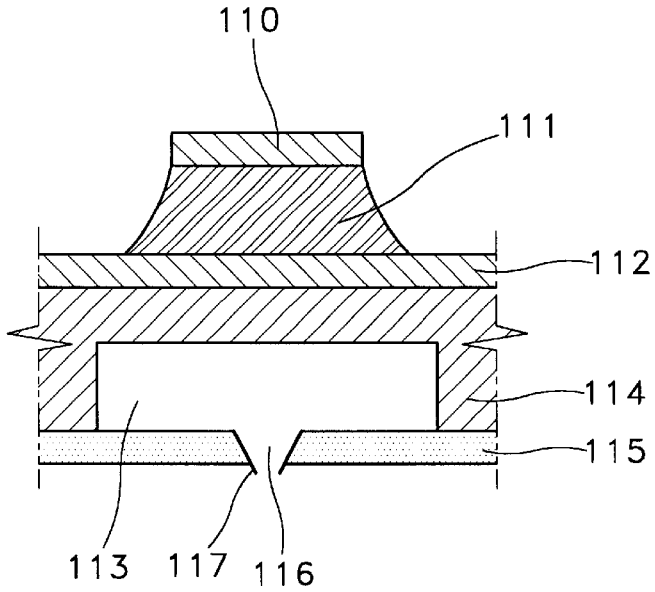
FIG. 4 is a cross section view of an example of an ink jet printer head of the present invention.

FIG. 4 shows an example of an ink jet printer head applying the nozzle plate of the present invention.

Such an ink jet printer head comprises a substrate 114, a chamber 113 formed under the substrate 114, a nozzle plate 115 formed under the substrate 114 and the chamber 113, a nozzle 116 formed in the nozzle plate 115, a boron layer 117 formed on the slope of the nozzle 116 so that the end is projected to media side, a lower electrode 112 formed on the substrate 114, a piezoelectric substance 111 formed on the lower electrode 112, and an upper electrode 110 formed on the piezoelectric substance 111.

Figure 5:
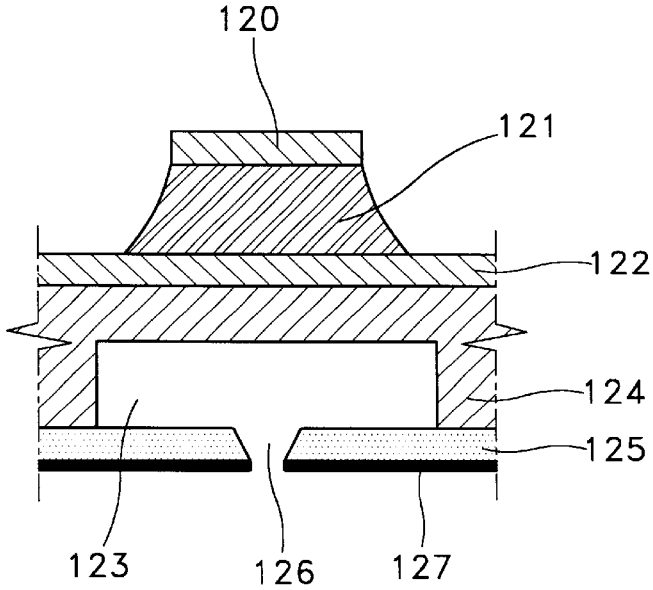
FIG. 5 is a cross section view of other example of an ink jet printer head of the present invention.

FIG. 5 shows other example of an ink jet printer head applying the nozzle plate of the present invention.

This ink jet printer head comprises a substrate 124, a chamber 123 formed under the substrate 124, a nozzle plate 125 formed under the substrate 124 and the chamber 123, a nozzle 126 formed in the nozzle plate 125, a boron layer 127 which is formed under the nozzle plate 125 and which forms a straight part at the outlet part of the nozzle 126, a lower electrode 122 formed on the substrate 124, a piezoelectric substance 121 formed on the lower electrode 122, and an upper electrode 120 formed on the piezoelectric substance 121.

Figure 6:
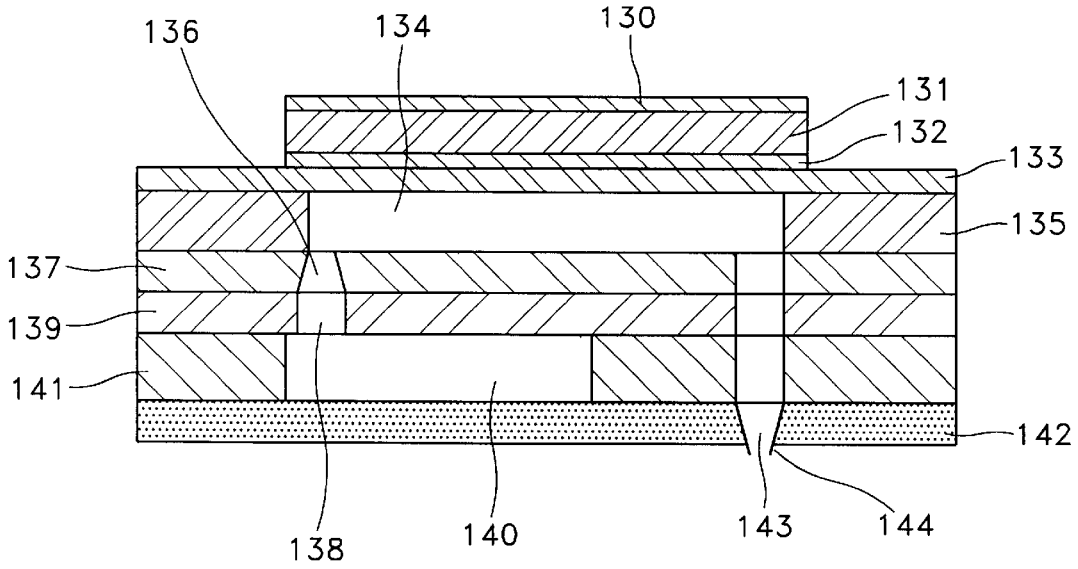
FIG. 6 is a cross section view of other example of an ink jet printer head of the present invention.

FIG. 6 shows an example of an ink jet printer head applying the micro actuator of the present invention.

The ink jet printer head of FIG. 6 comprises a substrate 133, a chamber plate 135 formed under the substrate 133, a chamber 134 formed in the chamber plate 135, a restrictor plate 137 formed under the chamber plate 135 and the chamber 134, a restrictor 136 formed in the restrictor plate 137, a channel plate 139 formed under the restrictor plate 137, a flow channel 138 formed in the channel plate 139, a reservoir plate 141 formed under the channel plate 139, a reservoir 140 formed by the reservoir plate 141, a nozzle plate 142 formed under the reservoir plate 141, a nozzle 143 formed in the nozzle plate 142, a boron layer 144 which is formed on the slope of the nozzle 143 and whose end is projected to media side, a lower electrode 132 formed on the substrate 133, a piezoelectric substance 131 formed on the lower electrode 132, and an upper electrode 130 formed on the piezoelectric substance 131.

Figure 7:
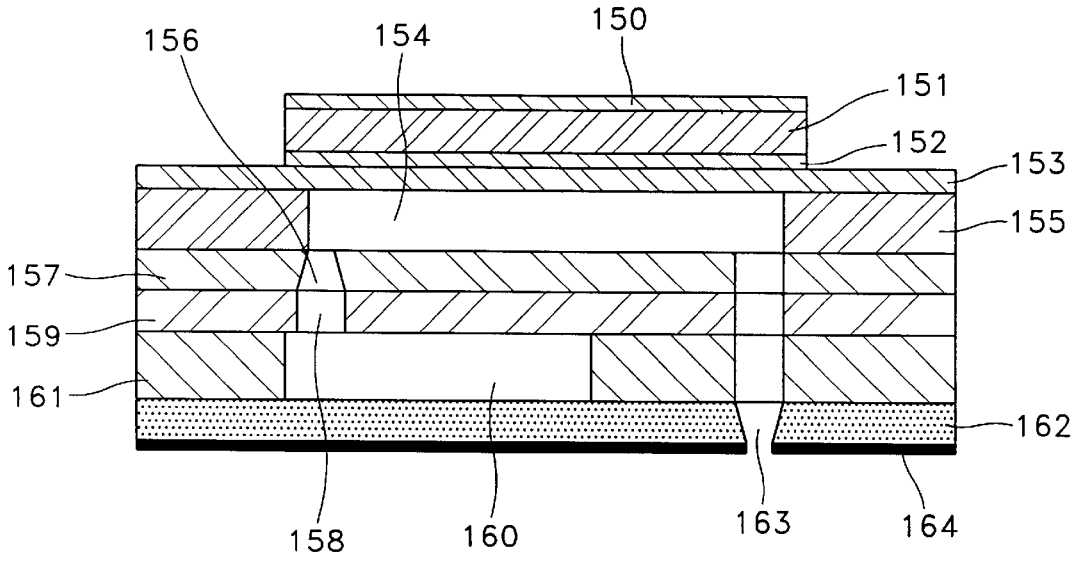
FIG. 7 is a cross section view of other practice example of an ink jet printer head of the present invention.

FIG. 7 shows another practice example of an ink jet printer head applying the micro actuator of the present invention.

The ink jet printer head of FIG. 7 comprises a substrate 153, a chamber plate 155 formed under the substrate 153, a chamber 154 formed in the chamber plate 155, a restrictor plate 157 formed under the chamber plate 155 and the chamber 154, a restrictor 156 formed in the restrictor plate 157, a channel plate 159 formed under the restrictor plate 157, a flow channel 158 formed in the channel plate 159, a reservoir plate 161 formed under the channel plate 159, a reservoir 160 formed by the reservoir plate 161, a nozzle plate 162 formed under the reservoir plate 161, a nozzle 163 formed in the nozzle plate 162, a chamber 154 formed by the substrate 153, the chamber plate 155 and the restrictor plate 157, a lower electrode 152 formed on the substrate 153, a piezoelectric substance 151 formed on the lower electrode 152, and an upper electrode 150 formed on the piezoelectric substance 151. A boron layer 164 is formed under the nozzle plate 162.

What is claimed is:

1. A method of manufacturing a nozzle plate using a silicon process comprising the steps of:

providing a silicon substrate;

forming a silicon oxide film on one side of said silicon substrate;

patterning said silicon oxide film;

performing an anisotropic wet etching on said silicon substrate after shielding the surface of said silicon substrate where silicon oxide film has not been formed;

forming a boron layer having a thickness of 1–2 $\mu$m on the surface where silicon oxide film has been formed in said silicon substrate;

etching said silicon substrate where said boron layer has been formed;

and removing said silicon oxide film and said boron layer formed on said silicon oxide film by etching the silicon oxide film.

2. The method of claim 1, further comprising a step of forming a silicon oxide film on an interface of said silicon substrate with a flow channel.

3. The method in claim 2, wherein said silicon oxide film is formed 0.5–3 $\mu$m thick.

4. The method in claim 2, wherein said silicon oxide film is formed by method of heat treatment after forming it by chemical vapor deposition, sputtering or thermal oxidation of silicon substrate.

5. The method of claim 1, wherein said silicon oxide film has a thickness of 0.5–3 $\mu$m.

6. The method of claim 1, wherein said silicon oxide film is formed by method of heat treatment after forming it by chemical vapor deposition, sputtering or thermal oxidation of said silicon substrate.

7. The method in claim 1, wherein said boron layer contains boron at a concentration of $7\times10^{19}$ atoms/cm$^3$.

8. A method of manufacturing a nozzle plate using a silicon process comprising the steps of:

providing a silicon substrate;

forming a boron layer having a thickness of 1–2 $\mu$m on one surface of said silicon substrate;

masking another surface of said silicon substrate where the boron layer is not formed, into a desired pattern;

performing an anisotropic wet etching of said patterned silicon substrate;

masking said boron layer into a desired pattern; and forming a straight part at said boron layer by way of dry etching of said masked boron layer.

9. The method in claim 8, further comprising a step of forming a silicon oxide film on interface of said silicon substrate with flow channel.

10. The method in claim 9, wherein said silicon oxide film is formed 0.5–3 $\mu$m thick.

11. The method in claim 9, wherein said silicon oxide film is formed by method of heat treatment after forming it by chemical vapor deposition, sputtering or thermal oxidation of said silicon substrate.

12. The method in claim 8, wherein said silicon oxide film is formed 0.5–3 $\mu$m thick.

13. The method in claim 8, wherein said silicon oxide film is formed by method of heat treatment after forming it by chemical vapor deposition, sputtering or thermal oxidation of said silicon substrate.

14. The method in claim 8, wherein said boron layer contains boron at a concentration of $7\times10^{19}$ atoms/cm$^3$.

15. An ink jet printer head comprising:

a substrate;

a chamber which is formed under said substrate and which is open only in the bottom part;

a nozzle plate formed under said substrate and said chamber;

a nozzle to record by ejecting ink, formed in said nozzle plate;

a boron layer having a thickness of 1–2 $\mu$m which is formed on the slope of said nozzle and whose end is projected to media side;

a lower electrode formed on said substrate;

a piezoelectric substance which is formed on said lower electrode and which actuates when voltage is applied; and an upper electrode formed on said piezoelectric substance.

16. The ink jet printer head in claim 15, wherein said boron layer contains boron at a concentration of $7\times10^{19}$ atoms/cm$^3$.

17. An ink jet printer head comprising:

a substrate;

a chamber which is formed under said substrate and which is open only in the bottom part;

a nozzle plate formed under said substrate and said chamber;

a nozzle to record by ejecting ink, formed in said nozzle plate;

a boron layer with a thickness of 1–2 $\mu$m which is formed under the nozzle plate and which forms a straight part at the outlet part of the nozzle;

a lower electrode formed on said substrate;

a piezoelectric substance which is formed on said lower electrode and which actuates when voltage is applied; and an upper electrode formed on said piezoelectric substance.

18. The ink jet printer head in claim 17, wherein said nozzle plate is manufactured by the method of comprising the following steps:

providing a silicon substrate;

forming a silicon oxide film on one side of said silicon substrate;

patterning said silicon oxide film;

performing an anisotropic wet etching on said silicon substrate after shielding the surface of said silicon substrate where silicon oxide film has not been formed;

forming a boron layer on surface where silicon oxide film has been formed in said silicon substrate;

etching said silicon substrate where said boron layer has been formed;

and removing said silicon oxide film and said boron layer formed on said silicon oxide film by etching the silicon oxide film.

19. The ink jet printer head in claim 17, wherein said boron layer contains boron at a concentration of $7\times10^{19}$ atoms/cm$^3$.

20. An ink jet printer head comprising:

a substrate;

a chamber plate formed under said substrate;

a chamber formed in said chamber plate;

a restrictor plate formed under said chamber and said chamber plate;

a restrictor which is formed in said restrictor plate and which maintains the speed of ink flowing into chamber at a constant value;

a channel plate formed under said restrictor plate;

a flow channel which is formed in said channel plate and which is a travel path of ink;

a reservoir plate formed under said channel plate;

a reservoir to reserve the ink, formed by said reservoir plate;

a nozzle plate formed under said reservoir plate;

a nozzle to record by ejecting ink, formed in said nozzle plate;

a boron layer having a thickness of 1–2 $\mu$m which is formed on the slope of said nozzle and whose end is projected to media side;

a lower electrode formed on said substrate;

a piezoelectric substance which is formed on said lower electrode and which actuates when voltage is applied; and an upper electrode formed on said piezoelectric substance.

21. The ink jet printer head in claim 20, wherein said nozzle plate is manufactured by the method comprising the following steps:

providing a silicon substrate;

forming a silicon oxide film on one side of said silicon substrate;

patterning said silicon oxide film;

performing an anisotropic wet etching on said silicon substrate after shielding the surface of said silicon substrate where silicon oxide film has not been formed;

forming a boron layer on surface where silicon oxide film has been formed in said silicon substrate;

etching said silicon substrate where said boron layer has been formed;

and removing said silicon oxide film and said boron layer formed on said silicon oxide film by etching the silicon oxide film.

22. The ink jet printer head in claim 20, further comprising a silicon oxide film formed on interface of said nozzle plate and said flow channel.

23. The ink jet printer head in claim 22, wherein the thickness of said silicon oxide film is 0.5–3 $\mu$m.

24. The ink jet printer head in claim 20, wherein the thickness of said silicon oxide film is 0.5–3 $\mu$m.

25. The ink jet printer head in claim 20, wherein said boron layer contains boron at a concentration of $7\times10^{19}$ atoms/cm$^3$.

26. An ink jet printer head comprising:

a substrate;

a chamber plate formed under said substrate;

a chamber formed in said chamber plate;

a restrictor plate formed under said chamber plate;

a restrictor which is formed in said restrictor plate and which maintains the speed of ink flowing into chamber at a constant value;

a channel plate formed under said restrictor plate;

a flow channel which is formed in said channel plate and which is an ink travel path;

a reservoir plate formed under said channel plate;

a reservoir to reserve the ink, formed by said reservoir plate;

a nozzle plate formed under said reservoir plate;

a nozzle to record by ejecting ink, formed in said nozzle plate;

a boron layer having a thickness of 1–2 $\mu$m which is formed under said nozzle plate and which forms a straight part at the outlet part of said nozzle;

a lower electrode formed on said substrate;

a piezoelectric substance which is formed on said lower electrode and which actuates when voltage is applied; and an upper electrode formed on said piezoelectric substance.

27. The ink jet printer head in claim 26, further comprising a silicon oxide film formed on interface of said silicon substrate and said flow channel.

28. The ink jet printer head in claim 27, wherein the thickness of said silicon oxide film thickness is 0.5–3 $\mu$m.

29. The ink jet printer head in claim 26, wherein the thickness of said silicon oxide film is 0.5–3 $\mu$m.

30. The ink jet printer head in claim 26, wherein said boron layer contains boron at a concentration of $7\times10^{19}$ atoms/cm$^3$.

* * * * *